United States Patent [19]

Nishioka

[11] Patent Number: 4,766,874

[45] Date of Patent: Aug. 30, 1988

[54] SHOOTING CROSSBOW

[76] Inventor: Jim Z. Nishioka, 1268 Hemlock N.W., Salem, Oreg. 97304

[21] Appl. No.: 48,245

[22] Filed: May 11, 1987

[51] Int. Cl.[4] ..... F41B 5/00

[52] U.S. Cl. ..... 124/25; 124/DIG. 1

[58] Field of Search ..... 124/25, 23 R, 88, DIG. 1, 124/22, 24 R

[56] References Cited

U.S. PATENT DOCUMENTS

| | | | |
|---|---|---|---|
| 3,108,583 | 10/1963 | Andis | 124/25 |
| 3,224,427 | 12/1965 | Ronan | 124/25 |
| 3,242,917 | 3/1966 | Benedict | 124/25 |
| 4,018,205 | 4/1977 | Meyer | 124/23 R |
| 4,169,456 | 10/1979 | Van House . | |
| 4,178,904 | 12/1979 | Meininger | 124/41 A |
| 4,261,321 | 4/1981 | Nishioka | 124/25 |
| 4,649,891 | 3/1987 | Bozek | 124/25 |

*Primary Examiner*—Richard C. Pinkham
*Assistant Examiner*—Mark S. Graham

[57] ABSTRACT

A shooting bow includes a bowstring, an elongated frame extending longitudinally in a shooting direction of the bowstring, a pair of arms for providing a tension for the bow, and a pair of rotatable bowstring guide members on the pair of arms, respectively. The bowstring includes a main span extending between the guide members and a pair of end spans or cables extending from the guide members, respectively. The bow also includes a bowstring catch and trigger mechanism positioned on the frame for holding the bowstring in a drawn position and for releasing it to propel a projectile. Each of the arms includes a rigid portion and a flexible portion respectively. The flexible portions extend in a forwardly direction. A pair of pulleys on the frame positions the bowstring end spans forwardly of the guide member.

9 Claims, 1 Drawing Sheet

FIG. 1
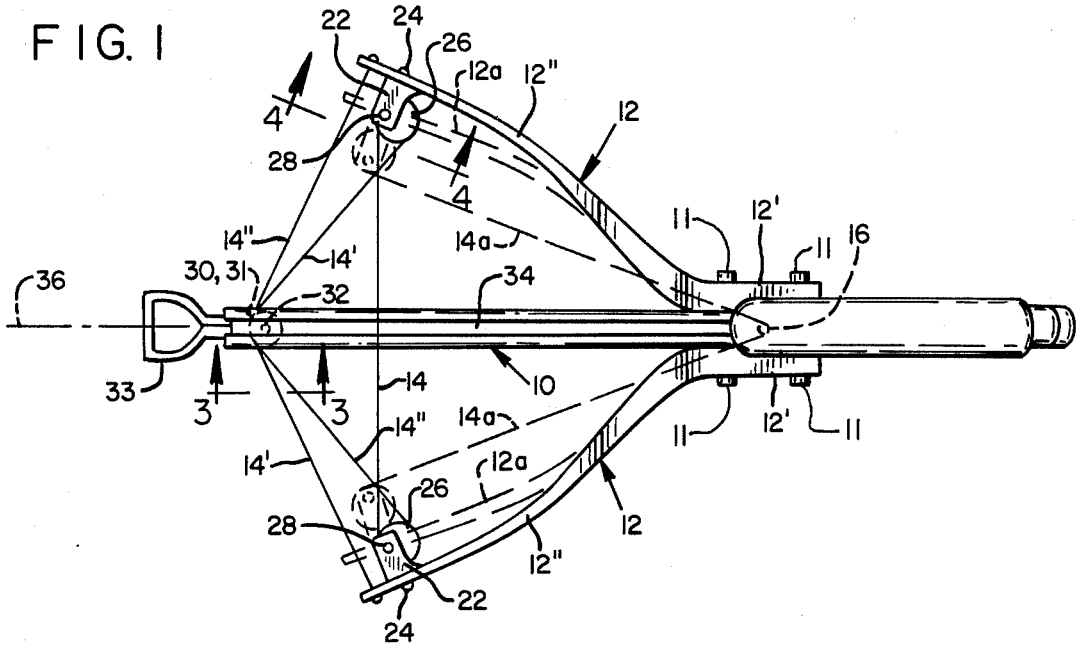
FIG. 2
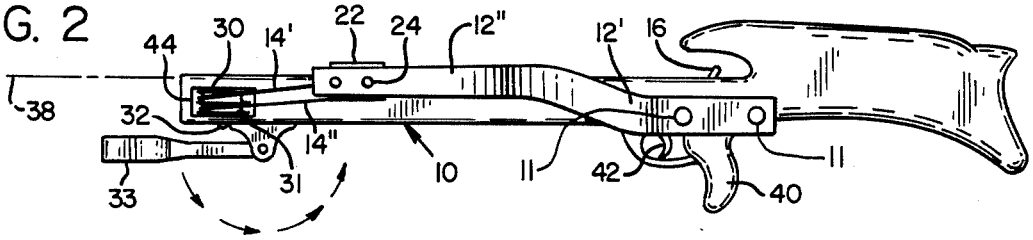
FIG. 3
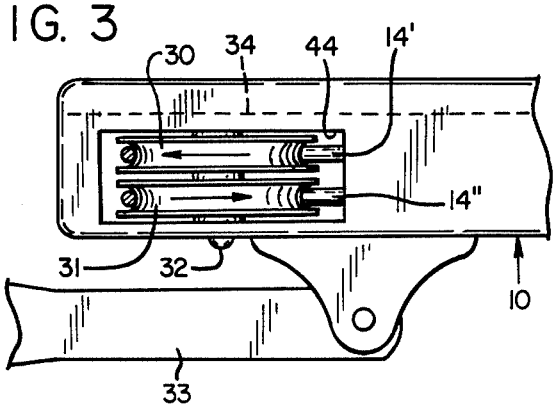
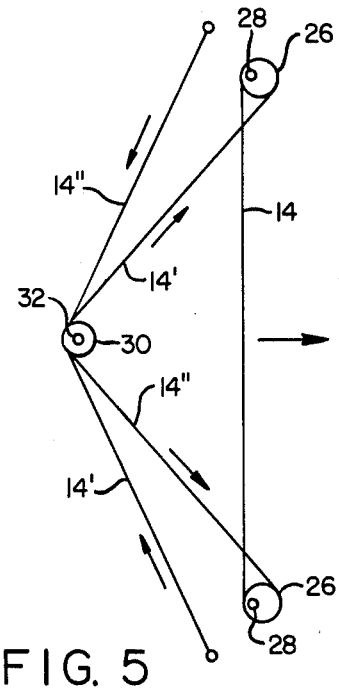
FIG. 5
FIG. 4
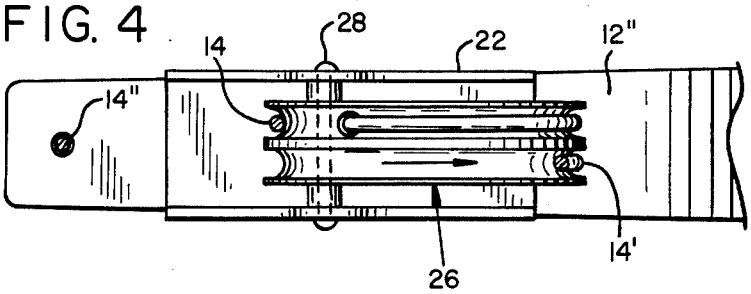

SHOOTING CROSSBOW

FIELD OF THE INVENTION

This invention relates to new and useful improvements in shooting bows.

SUMMARY OF THE INVENTION

According to the present invention and forming a primary objective thereof, a shooting bow is provided which is of the type employing tension provided by a pair of arms. The arms are positioned to provide a good power stroke for the bow. The bowstring end spans are positioned forwardly of the rigid portions of the bow arms.

In carrying out the objectives of the invention, the bow includes an elongated stock or frame. The arms are supported on the frame and extend in a forwardly direction.

The invention will be better understood and additional objectives and advantages thereof will become apparent from the following description taken in connection with the accompanying drawings.

BRIEF DESCRIPTION OF THE DRAWINGS

FIG. 1 is an overhead view of the shooting bow embodying principles of the present invention;

FIG. 2 is a side elevational view of the bow;

FIG. 3 is an enlarged framentary view taken on line 3—3 of FIG. 1;

FIG. 4 is an enlarged fragmentary view taken on line 4—4 of FIG. 1; and FIG. 5 is a diagram showing the relationship of the cams, the pulleys and the bowstring of the invention shown in FIG. 1.

DETAILED DESCRIPTION OF PREFERRED EMBODIMENT

With reference to the drawings, which show a preferred embodiment of the present invention, the shooting bow has a stock or frame 10, bolts 11 and a pair of arms 12. Each of the arms includes a rigid butt portion 12' and a flexible portion 12'', respectively. The bow also includes a bowstring 14 extending between the arms and a nut or bowstring catch 16. A pair of brackets 22 are secured by bolts 24 to the ends of the respective arms 12. A pair of eccentric cams 26 are rotatably supported on the brackets by a pair of shafts 28. The cams control a tension in the bowstring and provide a breakover action for the bow.

The cams guide the bowstring 14, such bowstring including a main span extending between the cams and a pair of end spans or cables 14' and 14'' extending from the cams.

A pair of pulleys 30 and 31 guide the bowstring end spans 14' and 14'' and position such spans forwardly of the bowstring meain span 14 and also forwardly of the rigid butt portions 12' of the bow arms 12. The pulleys are rotatably supported on the frame by a shaft 32. The pulleys rotate independently of each other and in opposite directions during drawing and shooting movements of the bowstring. The pulleys also are positioned forwardly of the flexible tension producing portions 12'' of the arms.

A pivotable stirrup 33 is also provided to assist in cocking the bow.

The bow also includes a track 34 for supporting and guiding a projectile to be shot by the bow. The track is the preferred construction, however, other forms of projectile supports, such as the common trackless type, may be employed to accomplish the same function. The pulleys 30 and 31 are positioned below the track.

The lateral center of the bow is indicated by a line 36 and a horizontal plane of a bowstring movement is indicated by a line 38.

A drawn position of the bowstring 14 engaged to the nut 16 is indicated by a broken line **14*a* and a drawn position of the arms is indicated by a broken line 12*a***.

The bow also includes a hand or pistol grip 40 and a trigger 42.

An opening 44 through a forward end portion of the frame 10 accommodates the pulleys 30 and 31. The bowstring end span or cable 14' wraps around pulley 30 in a counterclockwise direction and extends to the opposite arm where it is anchored. The bowstring end span or cable 14'' wraps around the pulley 31 in a clockwise direction and extends to the opposite arm where it is anchored.

The fact that the pulleys 30 and 31 position the bowstring end spans 14' and 14'' forwardly of the bowstring main span 14, the flexible tension producing portions 12'' of the arms 12, and the rigid butt portions 12' of the arms is an important feature of this invention. When the bowstring main span is drawn rearwardly the bowstring end spans will urge the forwardly extending flexible portions of the arms in a forwardly and inwardly direction. This reduces the stress on the arms during drawing and shooting movements of the bow. Furthermore, such forwardly placement of the bowstring end spans will help stabilize the arms to provide good projectile accuracy.

The power stroke of a bow is defined as the length of a forward projectile propelling movement of a bowstring when the bow is shot. Increasing the length of the power stroke of a bow increases its speed potential. The length of the power stroke of the present bow is shown in FIG. 1 as the drawn position of the bowstring **14*a*. The flexible tension producing portions 12'' of the arms are positioned forwardly of the rigid portions 12'** which provides the bow with a long power stroke for good projectile speed. Furthermore, the present bow utilizes the simplicity of the flexible arms while reducing the brace height of the bowstring.

The flexible tension producing portions 12'' of the arms 12 extend in a forwardly direction from the rigid butt portions 12' of the arms, the latter being rigidly secured to the frame 10. A pair of bolts 11 extends transversely through the rigid butt portions of the arms and through the frame and connects the arms to the frame. The rigid butt portions are elongated and extend longitudinally and substantially parallel to the frame.

Cams 26 are employed on the arms of this preferred construction of the bow, however, other devices such as pulleys may be employed to guide the bowstring.

The brackets 22 for supporting the cams 26 are shown as a hanging type, however, other devices performing the same function may be employed. Such devices include bows with split limb construction. Furthermore, the curvature of the bow arms 12 may be increased or decreased to change the leverage of the bowstring and positioning of the cams.

The arms 12 are secured to the frame 10 adjacent to the trigger 42. Such rearwardly positioning of the arms to the frame provides good balance and mass distribution for the bow.

The bowstring main span is positioned forwardly of the rigid butt portions 12' of the arms 12, such positioning of the main span reduces the brace height of the bowstring.

The cams 26 may be modified and various shapes and styles employed to control the bowstring travel and the flexing of the arms 12. Furthermore, the nut or bowstring catch 16 may be positioned more forwardly or more rearwardly on the frame 10 to decrease or increase bowstring travel.

Rotatable pulleys 30 and 31 are employed to position the bowstring end spans 14' and 14'', however, other devices such as rotatable rollers, cams or the like may be employed to accomplish the same function.

The bowstring main span 14 is shown positioned forwardly of the cams 26, however, the cams may be flopped so that the main span will be positioned rearwardly of the cams.

It is to be understood that the forms of my invention herein shown and described are to be taken as preferred examples of the same and that various changes in the shape, size and arrangement of parts may be resorted to without departing from the spirit of may invention or the scope of the subjoined claims.

Having thus described my invention, I claim:

1. A shooting bow comprising:

a bowstring including a main span and a pair of end spans, an elongated frame extending longitudinally in a shooting direction of the bowstring main span, a pair of arms connected to the frame, the arms each comprising a rigid butt portion and a flexible portion, respectively, the flexible portions providing a tension for the bowstring, a pair of rotatable bowstring guide members on the flexible portions of the arms, respectively, said bowstring main span extending between the rotatable bowstring guide members and the pair of bowstring end spans extending from the pair of rotatable bowstring guide members, respectively, a bowstring catch and trigger mechanism on the frame for holding the bowstring in a drawn position and for releasing it, said pair of flexible portions of the arms extending in a forwardly direction, means on the bow for engaging the bowstring end spans, said means being positioned forwardly of the rotatable guide members so that when the bowstring main span is drawn rearwardly said means will cause the end spans to apply an inwardly and a forwardly tension to the flexible portions of the arms.

2. The shooting bow of claim 1 wherein said means includes a pair of rotatable pulleys positioned on the frame for engaging the pair of bowstring end spans, respectively, said pair of pulleys being positioned forwardly of the forwardly extending flexible portions of the bow arms.

3. The shooting bow of claim 2 wherein said pair of pulleys rotate independently of each other, said pair of pulleys being supported on a common shaft.

4. The shooting bow of claim 3 wherein said pulleys rotate in opposite directions during a drawing movement of the bowstring main span.

5. A shooting bow comprising:

a bowstring including a main span and a pair of end spans, an elongated frame extending longitudinally in a shooting direction of the bowstring main span, a pair of arms connected to the frame, the arms each comprising a rigid butt portion and a flexible portion, respectively, said flexible portions extending forwardly from the rigid butt portions, respectively, a pair of rotatable bowstring guide members on the flexible portions of the arms, respectively, said bowstring main span extending between the rotatable bowstring guide members and the pair of bowstring end spans extending from the pair of rotatable bowstring guide members, respectively, a bowstring catch and trigger mechanism on the frame for holding the bowstring in a drawn position and for releasing it, said elongated frame including elongated opposite sides, said pair of rigid butt portions of the arms being positioned on the opposite sides of the frame, respectively, and extending in a forwardly direction, said bow also including connecting means for operatively connecting the forwardly extending butt portions of the arms to the opposite sides of the elongated frame, respectively, said connecting means also for positioning said forwardly extending butt portions substantially parallel to the elongated sides of the frame, said rigid butt portions being elongated members integrally connected to the flexible portions, said elongated member butt portions being positioned substantially adjacent to and substantially parallel to the elongated frame and operatively connected thereto.

6. The shooting bow of claim 5 wherein said connecting means extends transversely through at least one of the elongated member butt portions of the arms to connect the latter to the frame.

7. The shooting bow of claim 5 wherein said connecting means connects the pair of elongated member butt portions of the arms directly to the opposite sides of the frame, respectively,

8. The shooting bow of claim 5 wherein said connecting means includes multiple elongated elements extending through both the elongated member butt portions of the arms and also extending transversely into the elongated sides of the frame.

9. A shooting bow comprising:

a bowstring including a main span and a pair of end spans, an elongated frame extending longitudinally in a shooting direction of the bowstring main span, a pair of arms connected to the frame, the arms each comprising a rigid butt portion and a flexible portion, respectively, the flexible portions providing a tension for the bowstring, a pair of rotatable bowstring guide members on the flexible portions of the arms, respectively, said bowstring main span extending between the rotatable bowstring guide members and the pair of bowstring end spans extending from the pair of rotatable bowstring guide members, respectively, a bowstring catch and trigger mechanism on the frame for holding the bowstring in a drawn position and for releasing it, said elongated frame including elongated opposite sides, said pair of rigid butt portions of the arms being positioned on the opposite sides of the frame, respectively, and extending in a forwardly direction substantially parallel to the frame, said pair of rigid butt portions of the arms being secured to the opposite sides of the frame, respectively, said bow including projectile support means for engaging and slidably supporting a projectile, said pair of flexible portions and pair of rigid butt portions of the arms each having a top side and a bottom side, respectively, each of said top sides of said flexible portions being positioned above said projectile support means, each of said top sides of said forwardly extending rigid butt portions being positioned below the bowstring catch.

* * * * *